US005086832A

United States Patent [19]

Kadle et al.

[11] Patent Number: 5,086,832

[45] Date of Patent: Feb. 11, 1992

[54] MECHANICALLY INTERLOCKED MULTI TUBE HEAT EXCHANGER CORE

[75] Inventors: Prasad S. Kadle, Getzville; Douglas L. Sattelberg, North Tonawanda, both of N.Y.

[73] Assignee: General Motors Corporation, Detroit, Mich.

[21] Appl. No.: 706,531

[22] Filed: May 28, 1991

Related U.S. Application Data

[63] Continuation-in-part of Ser. No. 588,397, Sep. 26, 1990, abandoned.

[51] Int. Cl.[5] ..... F28D 1/03

[52] U.S. Cl. ..... 165/76; 165/152; 165/153; 165/178

[58] Field of Search ..... 165/76, 149, 152, 153, 165/176, 178

[56] References Cited

U.S. PATENT DOCUMENTS

| | | | |
|---|---|---|---|
| 1,302,627 | 5/1919 | Boblett | 165/152 |
| 3,292,690 | 12/1966 | Donaldson | 165/152 |
| 4,470,455 | 9/1984 | Sacca | 165/167 |
| 4,723,601 | 2/1988 | Ohara et al. | 165/153 |
| 4,800,954 | 1/1989 | Noguchi et al. | 165/153 |

FOREIGN PATENT DOCUMENTS

| | | |
|---|---|---|
| 62-248991 | 10/1987 | Japan . |
| 63-306394 | 12/1988 | Japan . |
| 1-57095 | 3/1989 | Japan . |

*Primary Examiner*—Allen J. Flanigan
*Attorney, Agent, or Firm*—Ronald L. Phillips

[57] ABSTRACT

A heat exchanger core having a plurality of spaced fluid conducting tubes operatively connected in series at their upper ends by projecting tank portions. The tubes have flattened main body portions that extend downward from the tank portions to terminal ends having rows of integral spacing and locking links formed with snap fasteners for releasably locking onto one another to connect the lower end of the tubes to one another providing column strength thereby preventing damage to corrugated metal air centers disposed between adjacent tubes by compression forces exerted on the core. In addition to the spacing and locking links, this core features integral snap fasteners to lock the separate plates of each tube together in face to face relationship so that the entire core is mechanically connected and interlocked and is ready for permanent connection by brazing.

3 Claims, 3 Drawing Sheets

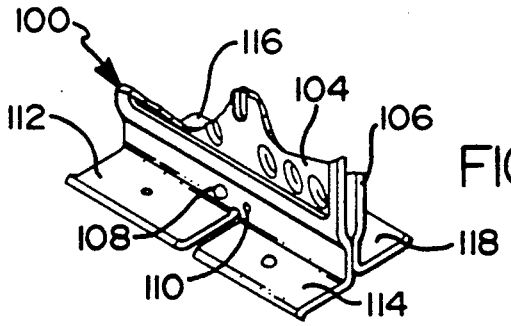
FIG 8
FIG 9
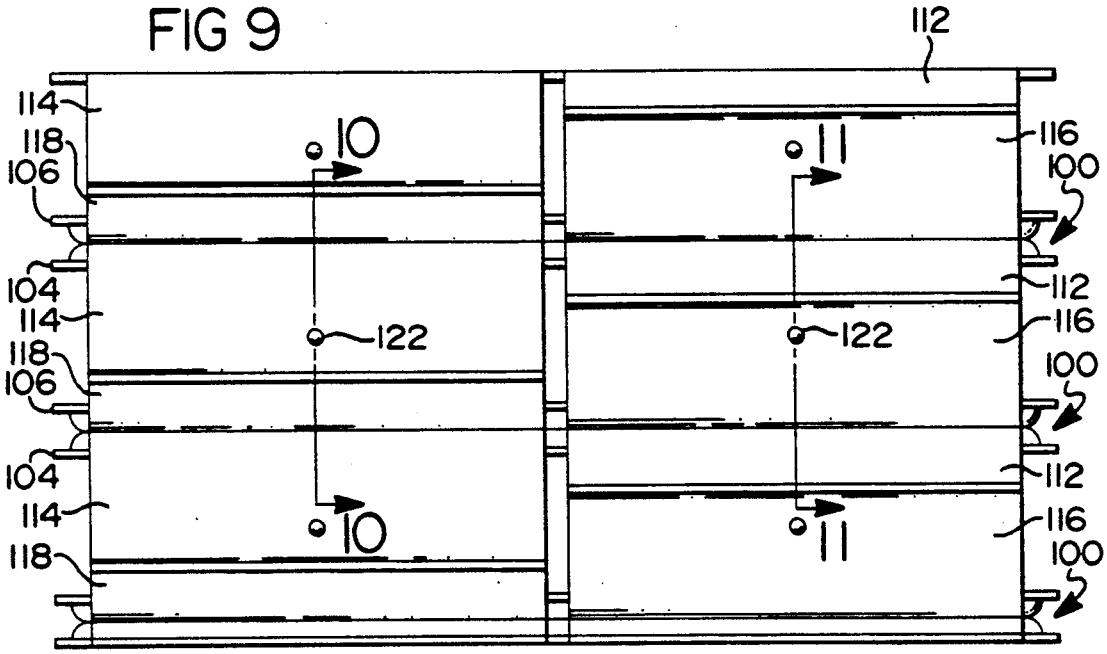
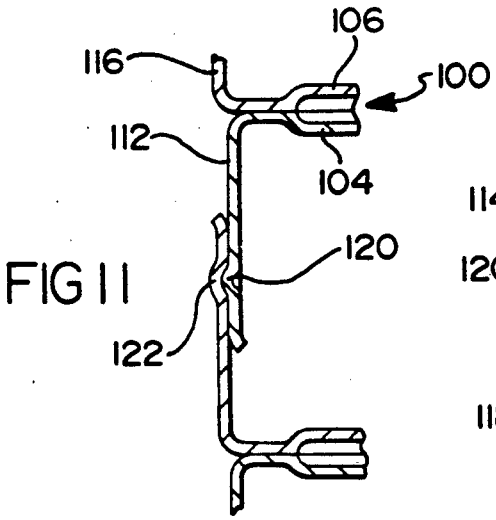
FIG 11
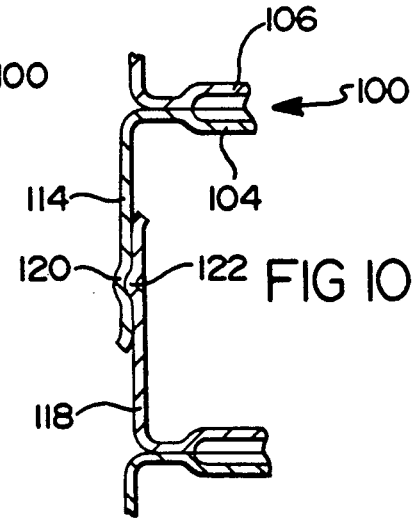
FIG 10

MECHANICALLY INTERLOCKED MULTI TUBE HEAT EXCHANGER CORE

This is a continuation-in-part of U.S. Pat. application Serial No. 07/588,397 filed Sept. 26, 1990, now abandoned.

BACKGROUND OF THE INVENTION

This invention relates to heat exchangers and more particularly to a heat exchanger core having a plurality of substantially identical tubes with integral spacing and locking links that maintain tube position and alignment and provide tube support so that the tubes can be compressively clamped and releasably held together for subsequent permanent connection by brazing without damage to the tubes or corrugated air centers therebetween.

FIELD OF INVENTION AND PRIOR ART

In order to produce a flat tube type heat exchanger such as is used in an evaporator in an automotive air conditioning system, thin plates are stamped from aluminum or other suitable metal. These plates, with brazing filler metal therebetween, are paired to form tubes which operatively interconnect with one another. The flattened main body portions of adjacent tubes are laterally spaced and receive corrugated air centers therebetween. These air centers are somewhat fragile being formed from thin sheets of aluminum or other metal that are installed in the spaces between adjacent tubes with brazing filler metal to form an initial buildup of the core. The stacked core is mechanically strapped or otherwise clamped and then brazed in an oven such as an induction furnace whose temperature is carefully controlled so as to be above the melting point of the brazing filler metal and below that of the metal core plates and the air centers. After brazing, the core is removed from the oven and the clamping straps are removed from the core. The brazed core is finished as needed for subsequent handling and installation in the air conditioning system.

SUMMARY OF THE PRESENT INVENTION

To precisely control the alignment and spacing of the plates and tubes formed therefrom and to prevent crushing of the air centers during the initial clamping and subsequent brazing operations, it is desirable to mechanically connect the plates to form core tubes and provide appropriate mechanical connection of the core tubes at both their upper and lower extremities. The present invention provides new and improved (1) locking construction for locking separate plates into tubes for the core and (2) spacing and locking links for the heat exchanger core tubing which effectively interconnects all of the tubes to one another and precisely spaces and supports the tubes so that a core can be built and clamped without damage to the core plates or the air centers prior to and during brazing.

In a preferred embodiment of this invention, each of the separate plates paired and locked together to make each tube is formed with discrete spacing and locking links which project generally transverse to the plane of the plate for mechanically joining adjacent tubes with one another at their lower ends. The spacing and locking links have "snap fastener" end connections that interfit to releasably interlock adjacent tubes together. These links also space separate tubes from one another and provide column support to protect the fragile air centers between the tubes from being crushed particularly when being clamped together and subsequently when being brazed. With the locking links in place, the tubes are arrayed in a core which is securely interlocked and accurately spaced and ready for handling, clamping and subsequent permanent connection by brazing.

The plate locks and the tube spacing and locking links facilitate the accurate build up of plates into tubes and tubes and air centers into a core and prevent crushing of the air centers and tubes when a clamping force is applied to the core assembly in preparation for brazing. This compressive force increases during brazing due to expansion of the core. However, the spacing and locking links hold the tubes together and provide column support to prevent damage to the air centers and other core components from these clamping and expansion forces. This construction accordingly optimizes plate alignment and interfitting into tubes and tube stacking and the production of a high quality brazed core.

It is a feature, object and advantage of this invention to provide a new and improved heat exchanger core having flattened tubes, each formed from a pair of plates that have integral spacing and locking links so that one end of each tube can be spaced and locked to corresponding end of an adjacent tube for the buildup of a exchanger core with tubes interlocked and accurately spaced for subsequent clamping and brazing without core damage.

These and other features, objects and advantages of the present invention will be more apparent from the following Detailed Description and Drawing in which:

DESCRIPTION OF THE DRAWING

FIG. 8 is a pictorial view of a tube illustrating another embodiment of the present invention.

FIG. 9 is a bottom view of a portion of a heat exchanger core illustrating interconnection of the tubes of FIG. 8.

FIG. 10 is a sectional view with parts removed taken along lines 10—10 of FIG. 9.

FIG. 11 is a sectional view with parts removed taken along lines 11—11 of FIG. 9.

Figure 1:
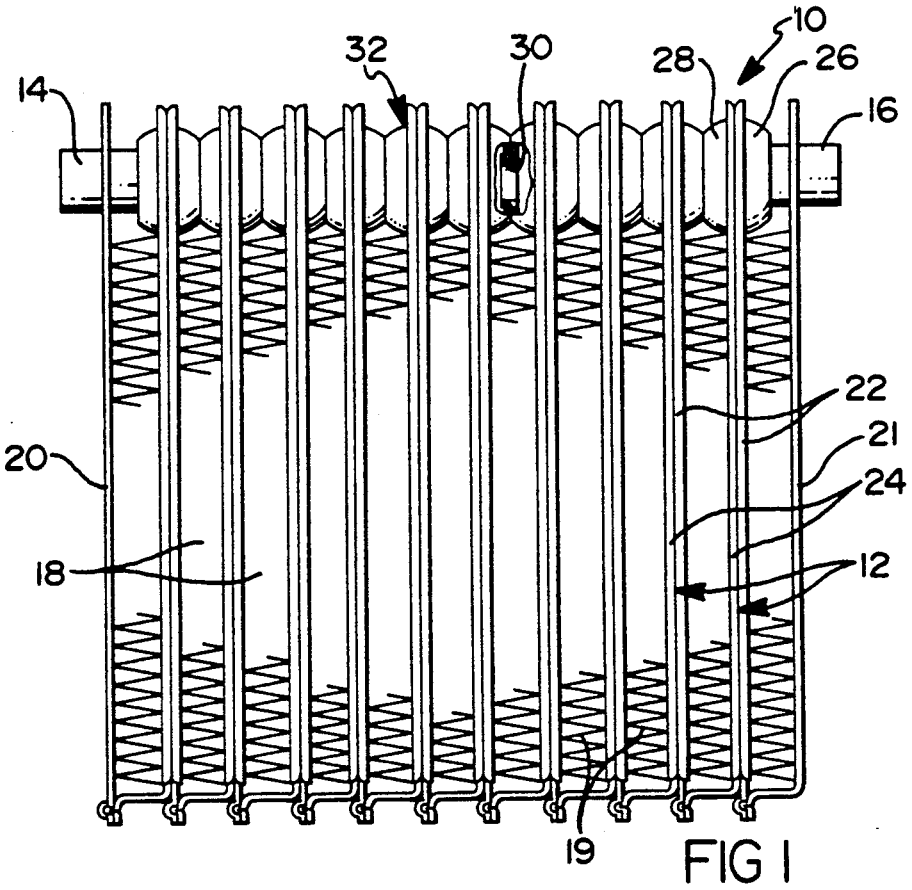
FIG. 1 is a front elevational view of an evaporator core for an automotive air conditioning system.

Turning now in greater detail to the drawings, there is shown in FIG. 1 a finned cross flow heat exchanger 10 in the form of an evaporator core for automotive air conditioning system adapted to be mounted within a module in the engine compartment of the automobile. The heat exchanger 10 comprises a plurality of generally flattened fluid conducting tubes 12 hydraulically connected with one another to provide a serpentined flow path for the heat exchanger fluid supplied thereto by way of an intake pipe 14 operatively connected into a first of the tubes 12. After changing phases while flowing through the core, the fluid is discharged from the last tube of the heat exchanger through a pipe 16 which can be operatively connected to the compressor of the air conditioning system not shown.

The separate tubes 12 are arranged in rank and are joined to each other at their upper and lower ends arranged to define spaces 18 therebetween which accommodate the corrugated air centers or fins 19. These air centers, fixed between the flattened body portions of each of the plate are corrugated thin sheets of aluminum or other suitable metal and are relatively fragile components of the heat exchanger core and, as known in this art, operate to increase the heat transfer performance of a heat exchanger. Flat end plates 20, 21 define opposite ends of the core as shown in FIG. 1 and air centers 19 are also operatively disposed between the end plates and these first and last tubes.

In an automotive air conditioner evaporator, a cross flow of air forces through the air centers loses heat energy to the refrigerant circulating through the tubes which boils and vaporizes and is then discharged by the pipe 16 to the compressor thereby cooling the interior of the automotive vehicle.

Each tube 12 is fabricated from a pair of mating plates 22 and 24 which are substantially identical to one another. Each plate 22 or 24 is a stamping which is substantially flat except that the upper end has a pair of side by side oval protuberances 26 and 28. When the tubes are stacked into a core, the protuberances 26 interconnect with protuberances 28 by shouldered openings such as opening 30, see FIG. 1, so that adjacent tubes are mechanically coupled and spaced at their upper ends. When the tubes are subsequently brazed together, they transmit heat exchanger fluid from the intake pipe to the outlet pipe through a serpentined path provided thereby. The interconnected protuberances define a tank portion 32 of the core.

In addition to the bulb-like protuberances, each of the plates is formed with an elongated inwardly projecting divider rib 33 (FIGS. 4 and 7) which extends longitudinally about ¾ of the length of the each plate for brazed connection to a corresponding rib of a mating plate to form a partition in the tube so that the refrigerant is forced in a circuitous path through each tube from the inlet to the outlet. Each core plate further has a pattern of inwardly extending dimples or bumps which, when the core plates are brazed together are connected at interfacing contact points to provide for optimized mechanical strength and varying flow paths through each tube for effective transfer of heat energy between the heat exchanger fluid and the ambient air.

Figure 2:
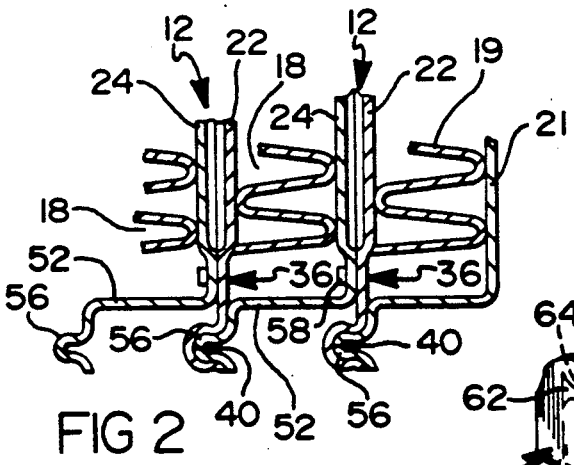
FIG. 2 is an enlarged view of a lower portion of the evaporator core of FIG. 1.
Figure 3:
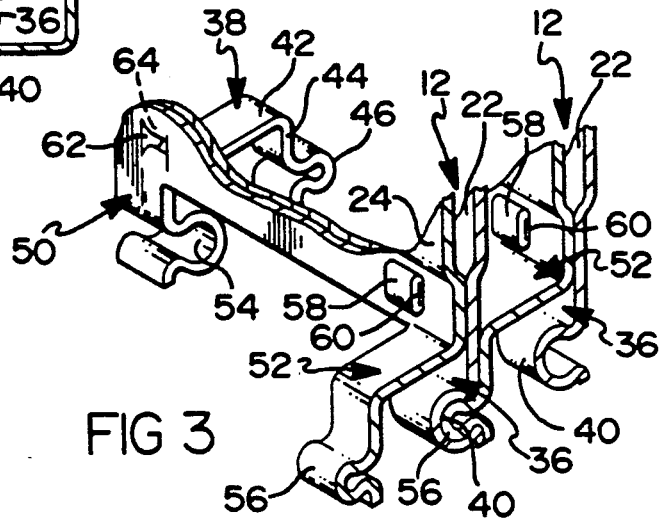
FIG. 3 is a pictorial view of a lower portion of the evaporator core of this invention showing the mechanical interlock thereof.

Each plate 22, which for description purposes is called a bottom plate, has first and second spacing and locking links 36 and 38 laterally separated from one another. As best shown in FIGS. 2 and 3, the first link 36 extends downward as an integral flap from the lower edge of plate 22. This flap has an indentation or pocket 40 formed therein that provides the receptacle half of a snap fastener connection described below.

The second spacing and locking link 38 has an elongated arm 42 that extends from the bottom edge of the plate and at right angles thereto to a downwardly extending terminal end 44 that has a protuberance 46 which is adapted to snap fit into the pocket of a spacing and locking link of a top plate of an adjacent tube as follows.

The top plates 24 are the same configuration as the bottom plates 22 and are interfaced therewith so as to form separate tubes. Accordingly, each top plate 24 has third and fourth spacing and locking links 50 and 52 corresponding to the first and second spacing and locking links on the bottom plate laterally separated from one another. The third spacing and locking link 50 has an indentation or pocket 54 which is adapted to provide a receptacle for the protuberance 46 of the second spacing and locking link 52 of an adjacent tube. The second spacing and locking link 52 has a flap like end extending downward with a protuberance 56 that fits in the pocket 40 of the first spacing and locking link 36 of the next adjacent bottom tube to interlock the tubes together.

In addition to the interconnecting locking links, the plates have snap fastener connections so together to form a tube 12. To this end, each bottom plate 22 has a protuberance 58 extending from the lower side which is adapted to fit in an opening 60 corresponding therewith in the adjacent top plate 24 as best shown in FIG. 3. Since the plates are identical, the top plate will also have a protuberance 62 which aligns with and fits into an opening or receptacle 64 in the bottom plate 22 to provide a snap fastener connection thereby interconnecting two plates together with side by side mechanical connecting joints.

Accordingly, with this invention, the core can be built up starting with a bottom plate 22 and then a top plate can be interlocked with the bottom plate such that the snap fastener connections 58, 60 and 62, 64 between the two plates holds them together to thereby form a tube. The tube will then have elongated spacing and locking links 38 and 52 extending laterally and in opposite direction from each tube to interconnect with the spacing and locking links 50 and 36 to effect the mechanically locked build of the tubes into a heat exchanger core. As the core is being built, the corrugated air centers 19 are interposed between adjacent tubes to increase the thermal efficiency of the heat exchanger. As shown in bottom and top, end plates 21 and 20 can be used in the core build with appropriate mechanical interconnection of spacing and locking links connecting the end plates to their next adjacent tubes.

With the spacing and locking links interconnected to one another to facilitate handling, and importantly to provide additional column support on both sides of the lower end of the heat exchanger, as well as at the tank, which is effective to resist compression loads which may be experienced as the built up core is strapped or otherwise clamped together for brazing in an oven. During such brazing, the expansion experienced by the core will increase these compressive loads which will be effectively resisted by the column support provided at the upper end by the tank and at the lower end of the heat exchanger by the spacing and locking links. Accordingly, the air centers and tubes will not be crushed or otherwise damaged.

Figure 4:
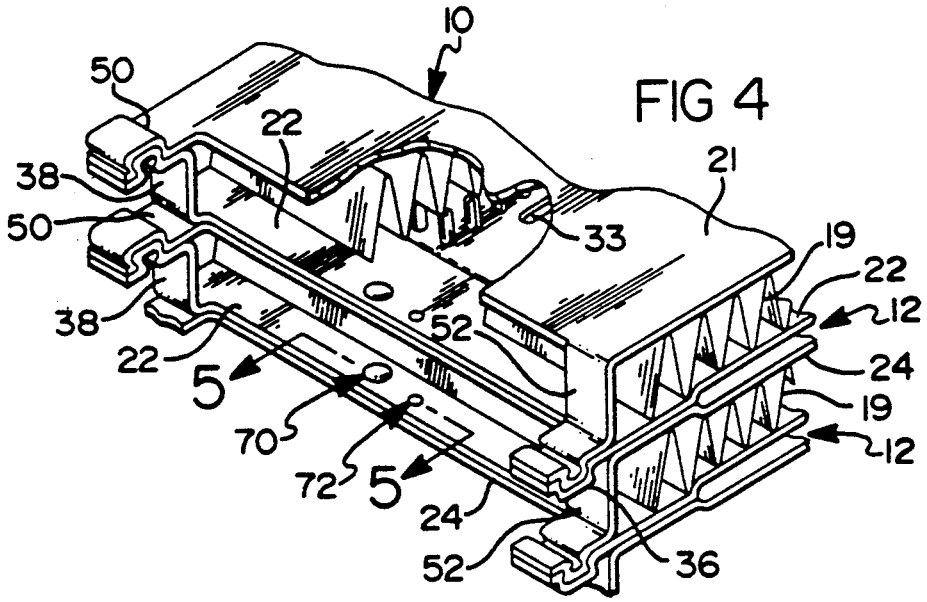
FIG. 4 is a pictorial view of a portion of lower end of a second exchanger embodying this invention showing the mechanical interlock.
Figure 5:
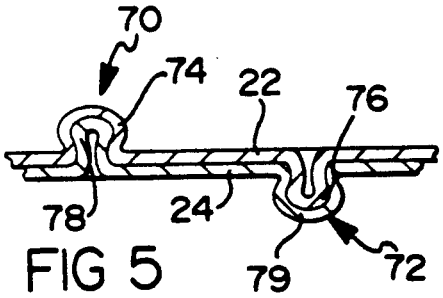
FIG. 5 is a sectional view taken along sight lines 5—5 of FIG. 4.

The construction of FIG. 4–5 is similar to that of FIG. 1 through 3 and the same reference numerals have been used to identify the same parts. In this embodiment, the mechanical interconnection of the bottom plates 22 with top plates 24 is by button type snap fasteners 70, 72. To this end, plate 22 is pressed with an annular receptacle 74 and a protuberance 76 in a side by side arrangement which snap fits into engagement respectively with the protuberance 78 and receptacle 79 of the top plate as shown best in FIG. 5. With this construction openings in the plates are minimized increasing tube strength and reducing leak paths. The spacing and locking links 62 and 64 that interconnect adjacent tubes are like those of FIGS. 1–3.

Figure 5A:
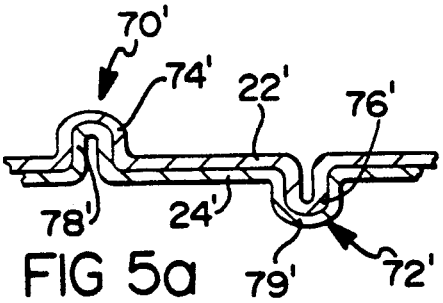
FIG. 5*a* is a view like FIG. 5 but of another embodiment of this portion of the heat exchanger.

In lieu of the snap fit mechanical fasteners 70, 72, the plates 22, 24 may be simply accurately located relative to each other for assembly as shown in FIG. 5*a* wherein parts similar to those in FIG. 5 are identified by the same numerals only primed. Rather than a snap or press fit, the plate 22' is pressed with a cylindrical receptacle 74' and protuberance 76' that slide or slip fit with a cylindrical protuberance 78' and receptacle 79' pressed in the plate 24'. Thus, rather than being required to effect a mechanical attachment between the plates which requires close tolerances, the button-type fasteners 70', 72' simply serve to accurately locate the plates relative to each other only.

Figure 6:
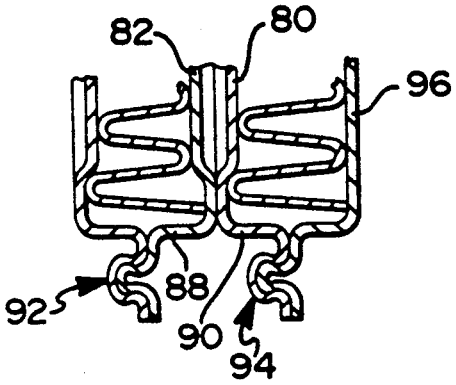
FIG. 6 is a cross sectional view of a portion of another heat exchanger showing an embodiment of this invention.
Figure 7:
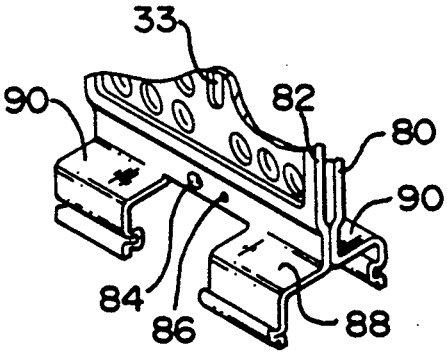
FIG. 7 is a pictorial view of one of the tubes of the heat exchanger of FIG. 6.

FIGS. 6 and 7 show similar constructions to that of FIGS. 1–3 and FIGS. 4–5 with snap fasteners connecting the plates into tubes and with spacing and locking arms connecting adjacent tubes. With the construction of FIGS. 6 and 7, the lower end of each plate 80, 82 is mechanically connected by snap fasteners 84, 86 as in FIG. 5. However, in this embodiment the locking and spacing arms 88, 90 are equal in length and are connected by snap fasteners 92, 94 at points intermediate any two adjacent tubes or between an end plate 96 and an adjacent tube. Other lengths of locking and spacing arms may be employed as desired.

In FIGS. 8 through 11, there is a further embodiment in which the tubes 100 of the heat exchanger core 102 are formed from identical plates 104, 106 joined in face to face relationship by snap fasteners 108, 110 in a manner such as shown in FIG. 5. Plate 104 has side by side spacer and joiner flaps 112, 114 that extend in one direction from the lower end of the plate. These flaps are somewhat like leaf springs. One flap 112 is inclined slightly upward and the adjacent flap 114 is inclined slightly upward as shown best in FIG. 8. The plate 106 which interfaces with plate 104 has corresponding flaps 116, 118 which extend in opposite lateral directions from flap 112 and 114 and respectively inclined upward and downward. FIG. 9 shows the spring overlap of the flaps so that a spring force joins adjacent tubes. FIGS. 10 and 11 illustrate interlocking of these spring flaps with mating detents 120, 122 effecting a connection so that the plates are positively mechanically interlocked and spaced at predetermined positions from one another. Air centers not shown are protected by this locking connection and the interlock between the plates provides for a completely mechanical interlock facilitating core alignment and handling prior to clamping and brazing.

While a preferred embodiment of the invention has been shown and described, other embodiments will now become apparent to those skilled in the art. Accordingly, this invention is not to be limited to that which is shown and described but by the following claims.

We claim:

1. A heat exchanger core having a series of flattened fluid flow tubes operatively interconnected with one another to transmit pressurized fluid therethrough from an intake to a discharge respectively operatively connected to the first and last of said tubs, each of said tubes having a tank portion at one end thereof, each said tank portion having an inlet and an outlet, each of said tubes having a main body portion defining an fluid flow path from said inlet to the outlet thereof, the improvement comprising first and second spacing and locking means on one end of each said tubes to releasably interlock with one another so that said tubes are spaced and supported at a predetermined distance from one another to prevent core damage by compressive forces applied to said tubes and to prevent said core from being pulled apart.

2. A heat exchanger core having a series of fluid flow tubes operatively interconnected in series with one another to provide a serpentine flow path for transmitting pressurized heat exchanging fluid therethrough from an intake operatively connected to a first of said tubes to a discharge operatively connected to a last of said tubes, each of said tubes having a flattened main body and having an enlarged fluid transferring tank portion forming one end thereof, each said tank portion having an inlet and an outlet for the fluid, said outlet of said tanks of said tubes being operatively connected to the inlet of the next adjacent tube downstream thereof, air center means operatively mounted between adjacent tubes, the improvement comprising snap connector locking link means on an end of each said tubes opposite said tank portion and disposed at a predetermined angle with respect to said main body to extend to and snap fit in the locking link means of the next adjacent tube to space said tubes from one another and to interconnect adjacent tubes to one another so that all of said tubes are interlocked together at their lower ends and are spaced at a predetermined distance from one another.

3. A heat exchanger core having a series of flattened fluid flow tubes operatively interconnected with one another to transmit pressurized fluid therethrough from an intake to a discharge respectively operatively connected to the first and last of said tubes, each of said tubes having a tank portion at one end thereof, each said tank portion having an inlet and an outlet, each of said tubes having a main body portion defining an fluid flow path from said inlet to the outlet thereof, the improvement comprising first and second spring like spacer and joiner flap means on one end of each said tubes to overlap one another to releasably join adjacent tubes, and detent means on each said flap to interact with one another so that said tubes are locked at a predetermined distance from one another to prevent core damage by compressive forces applied to said tubes and to prevent said core from being pulled apart.

* * * * *